US007640979B2

(12) United States Patent
Watson et al.

(10) Patent No.: US 7,640,979 B2
(45) Date of Patent: Jan. 5, 2010

(54) SYSTEM FOR WELL LOGGING

(75) Inventors: Arthur I. Watson, Sugar Land, TX (US); Michael H. Du, Pearland, TX (US); Ramez Guindi, Sugar Land, TX (US); Jacques Orban, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 145 days.

(21) Appl. No.: 11/426,140

(22) Filed: Jun. 23, 2006

(65) Prior Publication Data

US 2007/0295502 A1 Dec. 27, 2007

(51) Int. Cl.
*E21B 47/01* (2006.01)

(52) U.S. Cl. ..... 166/254.2; 166/241.5; 166/105; 166/65.1; 417/423.3

(58) Field of Classification Search ..... 166/254.2, 166/241.5, 385, 105, 65.1; 417/423.3
See application file for complete search history.

(56) References Cited

U.S. PATENT DOCUMENTS

| | | | | |
|---|---|---|---|---|
| 2,854,595 | A * | 9/1958 | Arutunoff | 310/87 |
| 5,099,919 | A * | 3/1992 | Schneider et al. | 166/188 |
| 5,213,159 | A | 5/1993 | Schneider | |
| 5,871,051 | A | 2/1999 | Mann | |
| 5,975,209 | A | 11/1999 | McCorry | |
| 6,120,261 | A | 9/2000 | Al-Towailib | |
| 6,497,278 | B1 | 12/2002 | Norris | |
| 6,688,860 | B2 * | 2/2004 | Du et al. | 417/423.11 |
| 6,695,052 | B2 | 2/2004 | Branstetter et al. | |
| 6,884,043 | B2 | 4/2005 | Kimberlin et al. | |
| 6,904,797 | B2 * | 6/2005 | Schrenkel et al. | 73/152.18 |
| 7,025,139 | B2 * | 4/2006 | Khomynets | 166/259 |
| 7,216,703 | B2 * | 5/2007 | Smith | 166/250.17 |
| 2004/0134653 | A1 | 7/2004 | Khomynets | |
| 2004/0251022 | A1 * | 12/2004 | Smith | 166/250.17 |

FOREIGN PATENT DOCUMENTS

| | | | |
|---|---|---|---|
| EP | 0854266 | B1 | 10/2002 |
| GB | 2297567 | A | 1/1995 |
| GB | 2391242 | A | 2/2004 |
| WO | 9000667 | A1 | 1/1990 |
| WO | 9012196 | A2 | 10/1990 |
| WO | 02075111 | A1 | 9/2002 |

* cited by examiner

*Primary Examiner*—Shane Bomar
(74) *Attorney, Agent, or Firm*—James L. Kurka; Kevin B. McGoff; Robert A. Van Someren

(57) ABSTRACT

A technique is provided to facilitate logging in a well environment. Downhole well related equipment is deployed in a wellbore with an internal, longitudinal passageway. A logging tool system is moved through the longitudinal passageway for performance of logging procedures within the wellbore below the well related equipment.

18 Claims, 3 Drawing Sheets

SYSTEM FOR WELL LOGGING

BACKGROUND

Logging procedures are carried out in wells to evaluate a variety of well characteristics, including production characteristics and formation characteristics. Generally, a logging tool is moved downhole into a wellbore to perform the logging procedure. The logging tool can contain a variety of sensors for detecting many types of parameters that can be used to evaluate desired well characteristics.

In some applications, production logging procedures are carried out while well equipment is located within the wellbore. However, the presence of equipment within the wellbore creates difficulties with respect to logging past or below the equipment. Attempts have been made to utilize a Y-tool as a bypass while a pumping system is deployed downhole. The Y-tool is a diverter type device having two legs or passages with one dedicated to the pumping system and the other leading to the wellbore below the pumping system. In other attempts, the logging tool has been deployed alongside of an electric submersible pumping string via a wireline, and specially designed plates are used to protect the wireline from damage during installation of the pumping string and during logging procedures. However, such systems can be difficult to use and susceptible to damage. In still other attempts, a hollow shaft of a combined motor and pump has been used as both a production flow path and as a passageway along which components can be moved downhole. However, the system was not designed for operation until removal of the component from the hollow shaft to enable production flow. The system also did not incorporate a motor protector.

SUMMARY

In general, the present invention provides a system for logging within a wellbore while well equipment is deployed in the wellbore. The well equipment can be deployed downhole within the wellbore to perform a well related function, e.g. production of well fluid. A logging tool system is designed for cooperation with the well equipment and can be moved internally through the well equipment for performance of logging procedures beneath the well equipment.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for performing logging procedures in a well. For example, the system and methodology can be used for production logging while well equipment is deployed within the wellbore. In well operations, e.g. production operations, well equipment is deployed at the desired location within a wellbore. The well equipment is designed with a longitudinal passageway to accommodate passage of a well logging system to enable well logging procedures below the well equipment. By way of example, the well equipment may comprise an electric submersible pumping system having an internal, longitudinal passageway through which a well logging tool is deployed. The internal, longitudinal passageway can be designed to enable operation of the well equipment, e.g. operation of the electric submersible pumping system, during performance of the logging procedures.

Figure 1:
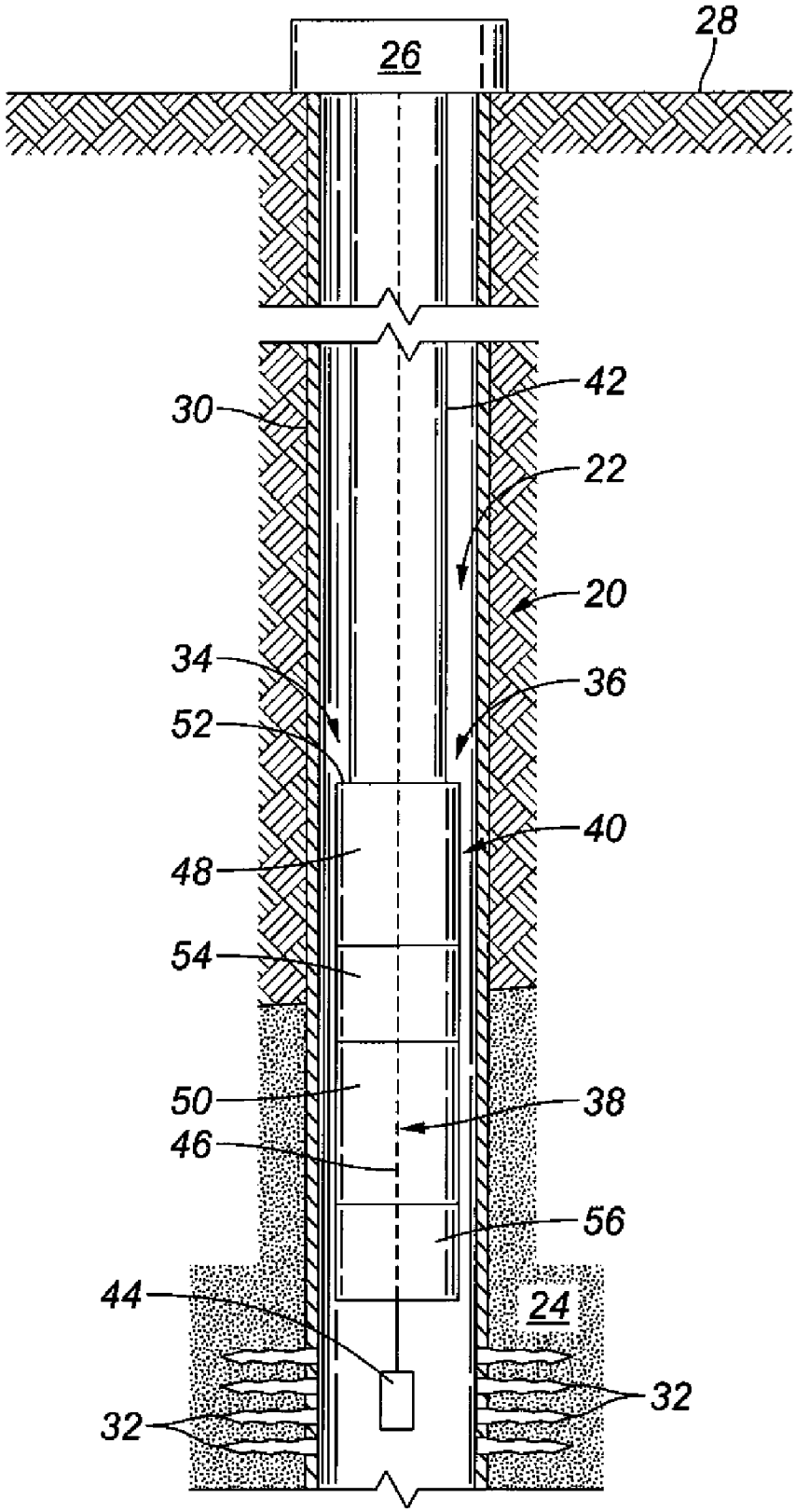
FIG. 1 is an elevation view of a wellbore with a well system therein, according to an embodiment of the present invention.

Referring generally to FIG. 1, a well 20 comprises a wellbore 22 that extends downwardly through one or more subterranean formations 24. The formations 24 often hold desired production fluids, such as hydrocarbon based fluids. In the example illustrated, wellbore 22 extends downwardly from a wellhead 26 located at a surface 28 above wellbore 22. Surface 28 may comprise a surface of the earth or a seabed floor. The wellbore 22 may be lined with a casing 30 and may have perforations 32 through which fluids can pass between formation 24 and wellbore 22.

A well system 34 is deployed in wellbore 22 and may have a variety of configurations depending on the specific well operation to be performed. Generally, well system 34 comprises well equipment, i.e. one or more well components 36, and a logging system 38 deployed longitudinally through an interior of the one or more well components 36. By way of example, well components 36 may comprise an electric submersible pumping system 40 deployed in wellbore 22 via a tubing 42, and logging system 38 may comprise a well logging tool 44 deployed through tubing 42 and well components 36 via a deployment line 46, such as a slick line or wireline. In the example illustrated, electric submersible pumping system 40 comprises a submersible pump 48 powered by a submersible motor 50. The submersible pump 48 may be coupled to tubing 42 by a pump head 52. Additionally, one or more motor protectors can be used, such as a motor protector 54 positioned between submersible motor 50 and submersible pump 48 and a lower motor protector 56 positioned below submersible motor 50. It should be noted, however, the number and arrangement of well components can change depending on the environment and specific well application. For example, motor protector 54 can be located at other positions along the electric submersible pumping system.

The well logging tool 44 on wireline 46 can be run through well components 36, e.g. through electric submersible pumping system 40, for performance of a well logging operation below well components 36. Additionally, the electric submersible pumping system can be operated to move well fluids during deployment of the logging tool or while the logging processes take place. In one embodiment, the well logging tool is moved through the electric submersible pumping system, and the wireline remains in a stationary position within a rotating shaft of the operating electric submersible pumping system, as discussed in greater detail below.

Figure 2:
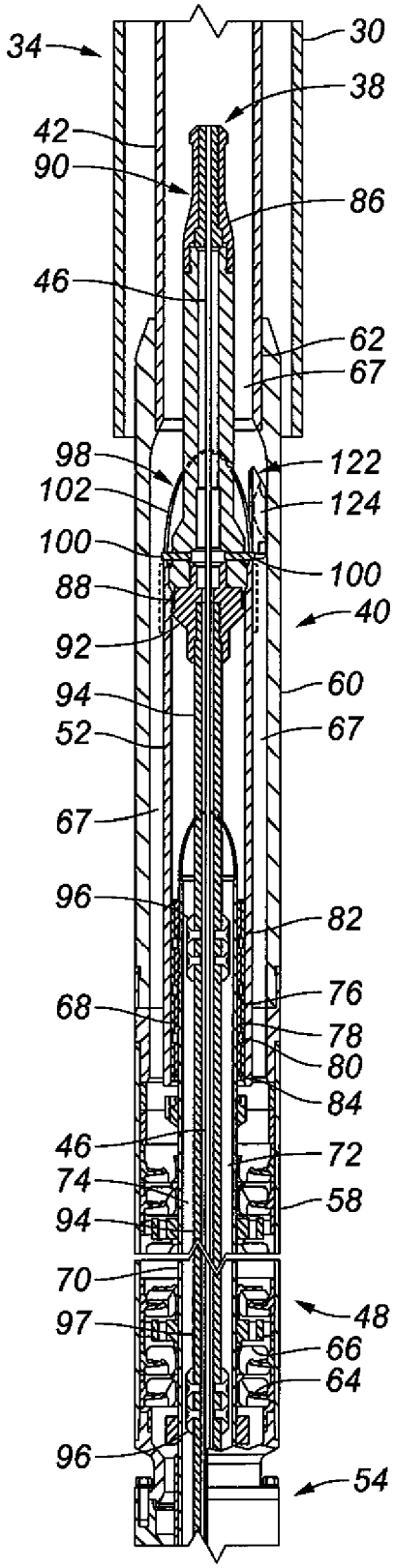
FIG. 2 is a cross-sectional view of a portion of the well system illustrated in FIG. 1 and showing well equipment deployed downhole in combination with a well logging system, according to an embodiment of the present invention.

An example of well logging system 38 extending through an upper portion of electric submersible pumping system 40 is illustrated in FIG. 2. As illustrated, submersible pump 48 comprises an outer housing 58 coupled to tubing 42 by an engagement portion 60 of the housing 58. Engagement portion 60 may be coupled to tubing 42 by, for example, a threaded engagement region 62. Submersible pump 48 further comprises a plurality of pumping stages having rotationally stationary diffusers 64 and corresponding rotatable impellers 66 for pumping wellbore fluid upwardly along a production fluid flow path 67 extending through at least a portion of electric submersible pumping system 40 and into tubing 42. The rotatable impellers 66 are rotated by a shaft 68 driven by submersible motor 50. Shaft 68 may be formed by a plurality of shaft sections 70 with individual shaft sections disposed in corresponding individual wellbore components, e.g. submersible pump 48, submersible motor 50 and motor protector 54.

In the embodiment illustrated, the shaft 68 has a hollow interior 72 forming a longitudinal passageway 74 through which well logging system 38 is moved longitudinally along an interior of well system 34. Longitudinal passageway 74 is separate from production fluid flow path 67 which facilitates production of fluid while, for example, wireline 46 extends through longitudinal passageway 74. The upper end of shaft 68 is rotatably coupled with pump head 52 which may be positioned within engagement portion 60 of submersible pump housing 58. By way of example, the coupling of shaft 68 and pump head 52 may be achieved with a series of labyrinth seals 76 that seal the pump discharge pressure during logging procedures, such as production logging. Seals 76 also can be used as journal bearings similar to those in a conventional submersible pump head, and the seals may be made from a bearing material, such as graphitized silicon carbide. By using multiple sections of labyrinth seals, the likelihood of forming cracks is reduced and the total pressure load over the region is divided.

As an alternate embodiment, a "leaky" seal can be used around wireline 46 to generate a hydraulic downward friction force on the wireline cable 46 inside shaft 68. The downward force is particularly useful with a stiff wireline cable 46 that resists buckling when pushed. Combining the stiff cable and pushing force is helpful when logging certain types of wells including highly deviated wells, e.g. horizontal wells. The pushing force can enable performance of the logging operation in a highly deviated well without a wireline tractor. The specific location of the "leaking" fluid can be varied as long as the fluid is directed along the wireline cable to create the desired insertion force on the wireline.

The coupling also may utilize sleeves 78 and load rings 80 positioned along the shaft 68 intermediate labyrinth seals 76. Bushings 82 can be positioned radially outward of the sleeves 78 within pump head 52 such that sleeves 78 rotate with shaft 68 within stationary bushings 82. Additionally, a retaining ring 84 can be positioned generally at the lower end of pump head 52. O-rings can be used in mounting sleeves 78 to shaft 68 to eliminate leakage under the sleeves. O-rings also can be used along the outside diameter of bushings 82 to provide flexibility for the bushing mounting and to ensure alignment with the corresponding sleeves.

Well logging system 38 is designed for insertion through the interior passageway 74, e.g. through the hollow interior 72 of electric submersible pumping system shaft 68, for well logging operations below the electric submersible pumping system. In the embodiment illustrated, well logging system 38 comprises a logging plug 86 used to seal the production pressure against the well pressure during logging processes. Logging plug 86 effectively becomes a seal mechanism between the logging system 38 and the surrounding component, e.g. submersible pump 48. By way of example, the logging plug 86 may utilize a seal 88, such as a V-pack seal, to seal against the inside diameter of pump head 52. Logging plug 86 further comprises an upper portion 90 coupled to wireline 46 and a lower portion 92 connected to a wireline guard 94. Wireline guard 94 hangs from logging plug 86 and may extend through the entire length of well components 36, e.g. electric submersible pumping system 40. By way of example, the wireline guard 94 may be made of a wear resistant, non-galling metal to prevent damage to wireline 46. Additionally, the wireline guard can be split into sections of convenient length to facilitate assembly onto wireline 46 at wellhead 26. The wireline guard sections are joined by couplings 96 to protect the wireline over the entire length of shaft 68. The couplings 96 also can be used to provide a bearing surface for isolating the wireline guard 94 from the internal wall of shaft 68. In this embodiment, couplings 96 are made of a sacrificial material able to protect the wireline guard 94 during logging processes without damaging the interior of shaft 68. By way of example, wireline guard 94 may be formed as sections of pipe with the wireline inserted. However, if the wireline guard 94 is longer than the maximum displacement of the elevator (not shown) used in deploying the system, other styles of wireline guard 94 and other installation techniques can be used. For example, the wireline guard 94 can be formed as a split pipe or as a pipe with an axial or spiral groove 97. The split/grooved pipe enables side installation of wireline 46 on, for example, the rig floor while the wireline extends into the well.

Figure 3:
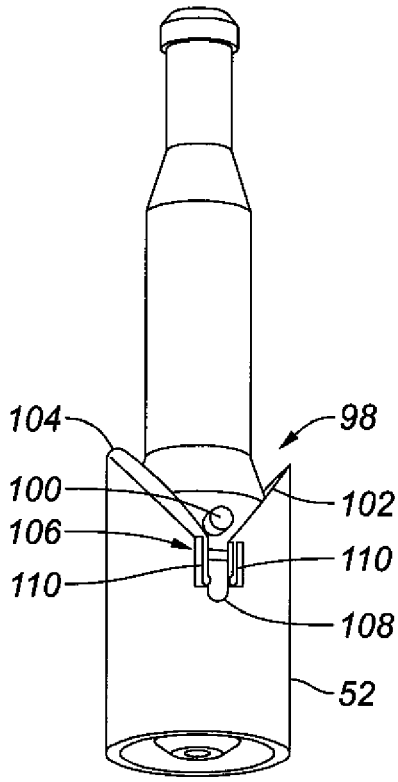
FIG. 3 is an orthogonal view of a logging plug and a latch mechanism, according to an embodiment of the present invention.

As further illustrated in FIGS. 2 and 3, a latching mechanism 98 is used to latch logging plug 86 to pump head 52. In the embodiment illustrated, logging plug 86 comprises one or more anti-rotation pins 100 that extended generally radially outward for engagement with a pin guide 102, such as a mule shoe, that forms part of pump head 52. Pin guide 102 includes a guide surface 104 that may comprise various geometries designed to guide pins 100 into a corresponding retention mechanism 106 having retention slots 108. Retention mechanism 106 further comprises retention fingers 110, such as beam-spring fingers, designed to maintain pins 100 in retention slots 108 during logging processes. The fingers 110 also provide predictability with respect to the forces required when pushing plug 86 into or pulling plug 86 out of retention slots 108. The retention fingers 110 also prevent logging plug 86 from moving backwards, e.g. in an upward direction, during logging processes. When pins 100 are engaged with retention slots 108, the logging plug 86 is prevented from rotating during the logging processes.

Figure 4:
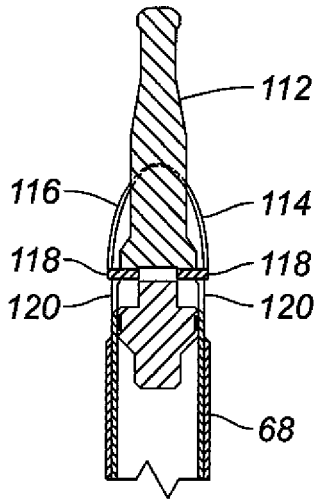
FIG. 4 is a cross-sectional view of a plug that can be used to seal off the longitudinal logging passageway when a logging procedure is not being performed, according to an embodiment of the present invention.

Upon completion of the desired logging processes, well logging tool 44 and wireline 46 can be withdrawn through hollow interior 72 of shaft 68. A production plug 112 can be used to plug the hollow shaft 68 during normal, non-logging operation of electric submersible pumping system 40, as illustrated in FIG. 4. The production plug 112 may be made with a latching mechanism guide 114, similar to the latching mechanism pin guide 98 for receiving logging plug 86. Latching mechanism guide 114 comprises a guide surface 116 for guiding one or more pins 118 that extend outwardly from production plug 112. Retention fingers 120 can be used to hold pins 118 and to retain production plug 112 at the end of the hollow shaft 68 during normal, non-logging operations.

Alternatively, a trip saver mechanism 122 can be used instead of production plug 112, as illustrated by the dashed lines of FIG. 2. In this embodiment, trip saver mechanism 122 is used to seal shaft 68 without requiring an additional trip downhole to move production plug 112 into latching mechanism 114. In one example, trip saver mechanism 122 comprises a valve 124, such as a flapper valve similar to flapper valves used in safety valves. The valve 124 is normally closed during non-logging production of well fluid, but the valve is activated to an open position, as illustrated, during logging processes. The valve can be opened via hydraulic or mechanical actuation similar to conventional flapper valves, as known to those of ordinary skill in the art.

Figure 5:
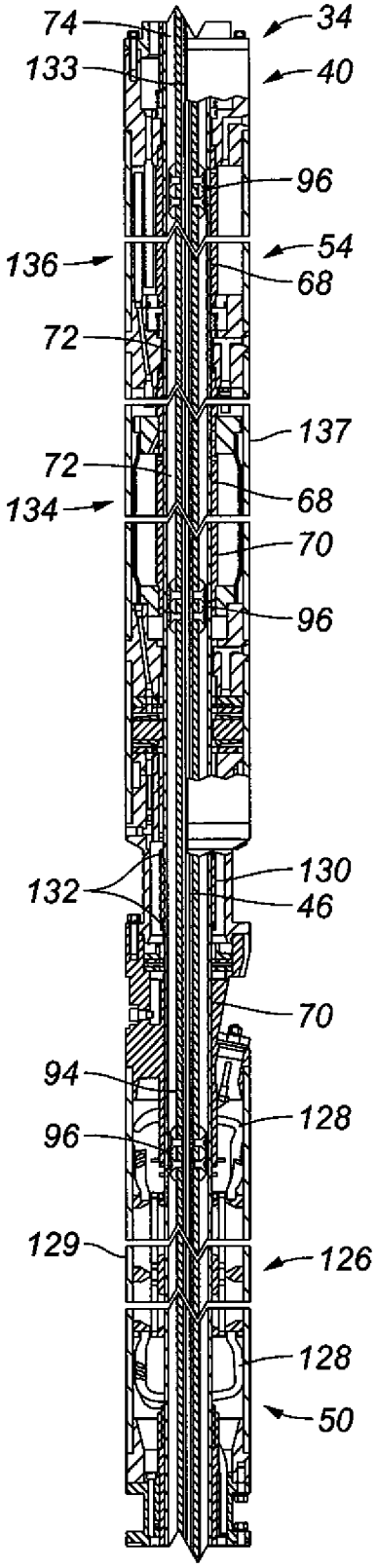
FIG. 5 is a cross-sectional view of another portion of the well system illustrated in FIG. 1 and showing additional well equipment deployed downhole in combination with the well logging system, according to an embodiment of the present invention.
Figure 6:
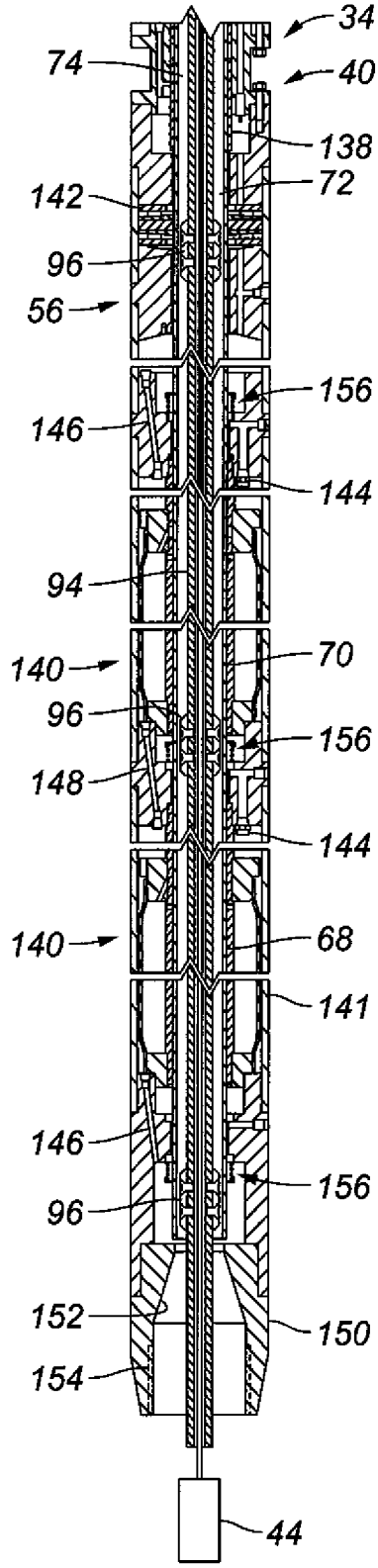
FIG. 6 is a cross-sectional view of another portion of the well system illustrated in FIG. 1 and showing additional well equipment deployed downhole in combination with the well logging system, according to an embodiment of the present invention.

When well components 36 comprise electric submersible pumping system 40, additional pump related components are integrated into the system, as illustrated in FIGS. 5 and 6. Referring first to FIG. 5, a portion of electric submersible pumping system 40 is illustrated as showing motor protector 54 and submersible motor 50. Submersible motor 50 may be constructed similar to conventional submersible motors utilized in electric submersible pumping systems. For example, submersible motor 50 may be constructed with conventional rotor and stator sections 126 combined with conductors that are connected by end coils 128 all located within an outer housing 129. However, submersible motor 50 is designed to accommodate log-through procedures by virtue of its hollow shaft section 70 that forms part of overall hollow shaft 68.

Similarly, motor protector 54 also incorporates its own hollow shaft section 70 that forms part of overall hollow shaft 68. The hollow shaft sections 70 of submersible motor 50 and motor protector 54 are connected by a sealed shaft coupling 130 having a plurality of seals 132 that seal the coupling 130 to prevent exposure of the motor oil within submersible motor 50 to well fluid or contaminants within hollow shaft 68. A similar sealed shaft coupling 133 can be used to connect the hollow shaft section of motor protector 54 with submersible pump 48. Apart from its hollow shaft section 70 for accommodating log-through procedures, motor protector 54 can be constructed according to a variety of conventional motor protector designs. For example, the motor protector 54 may be constructed with one or more bag sections 134 and/or one or more labyrinth sections 136 located within an outer motor protector housing 137.

As with submersible pump 48, logging system 38 can be moved along the hollow interior 72 of shaft 68 in both motor protector 54 and submersible motor 50. The hollow interior through motor protector 54 and submersible motor 50 accommodates the passage of well logging tool 44 and wireline 46. As discussed above, the wireline 46 can be protected by sections of wireline guard 94 connected together by couplings 96. The couplings 96 further serve as bearings within motor protector 54 and submersible motor 50 to provide a bearing surface that isolates wireline guard 94 from the inside surface of the hollow shaft section 70.

Referring to FIG. 6, lower motor protector 56 can be connected below submersible motor 50 and comprises its own hollow shaft section 70 connected to the hollow shaft section 70 of submersible motor 50 by a sealed shaft coupling 138. The lower motor protector 56 can be constructed according to a variety of designs with numerous combinations of motor protector sections and components. By way of example, lower motor protector 56 may be designed as a bag-type protector having one or more bag sections 140 located within an outer protector housing 141. However, the bag sections in the lower protector 56 can be designed with smaller bags than those used in motor protector 54. The lower protector 56 also can be designed with a thrust bearing 142 to counteract forces acting on shaft 68 during operation of electric submersible pumping system 40. Lower protector 56 also may incorporate other features found in conventional motor protectors, such as relief valves 144 and breathing paths 146. However, a pathway 148 normally extending between bag sections 140 can be plugged or blocked when the motor protector is used as a lower motor protector in electric submersible pumping system 40. Lower motor protector 56 also comprises a lower end 150 having a hollow interior 152 that may be smooth or that may comprise a threaded section 154 to enable the connection of additional equipment below lower motor protector 56.

The lower motor protector 56 further comprises redundant seals, such as redundant rotating mechanical face seals 156 positioned about shaft 68. The shaft seals 156 and the flow paths 146 are arranged to prevent the static head of oil within submersible motor 50 and motor protector 54 from opening the shaft seals 156 and expelling oil while the well system 34 is suspended for installation into wellbore 22. In the embodiment illustrated, the two upper shaft seals 156 are inverted to resist the higher static pressure from the static head of oil. The lower shaft seal 156, however, may be positioned in a standard motor protector orientation. In some embodiments, lower motor protector 56 can simply rely on a lower rotary shaft seal 156 to isolate the motor oil from the well fluid. The use of an oil compensation system, such as bag sections 140, may not be necessary if motor protector 54 has a sufficient system to fully compensate for changes in motor oil volume.

As with submersible pump 48, motor protector 54, and submersible motor 50, logging system 38 can be moved along the hollow interior 72 of shaft 68 in lower motor protector 56. The hollow interior through lower motor protector 56 accommodates the passage of well logging tool 44 and wireline 46. Again, the wireline 46 can be protected by sections of wireline guard 94 connected together by couplings 96.

Specific components used in well system 34 can vary depending on the actual well application for which they are used. The location and orientation of the longitudinal interior passageway 74 can be adjusted depending on the type of well components used in a given application. If the well system comprises an electric submersible pumping system, the design and arrangement of the pumping system components can vary. For example, a variety of sections, such as bag sections and labyrinth sections, can be incorporated into the motor protectors. Additionally, the number and arrangement of submersible pumps, submersible motors and motor protectors can be adjusted to the specific well environment, well application and production requirements. Other components can be attached to, or formed as part of, the electric submersible pumping system.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of using a well logging tool, comprising:

deploying an electric submersible pumping system comprising an electric submersible pump in a wellbore;

running a logging tool through an interior passageway of the electric submersible pump to a position below the internal passageway of the electric submersible pump, while the electric commercial pump is positioned in the wellbore and while operating the electric submersible pump; and producing a well fluid along a flow path that does not enter the interior passageway while the logging tool is through the interior passageway.

2. The method as recited in claim 1, wherein running comprises running the logging tool longitudinally through a shaft of the electric submersible pumping system.

3. The method as recited in claim 2, wherein running comprises moving the logging tool through the shaft via a wireline.

4. The method as recited in claim 3, further comprising shielding the wireline from the shaft by a wireline guard.

5. The method as recited in claim 3, further comprising shielding the wireline from the shaft by a wireline guard having a split region for installation of the wireline.

6. The method as recited in claim 4, further comprising sealing the wireline to a pump head with a logging plug.

7. A system, comprising:

an electric submersible pumping system comprising an electric submersible pump, the electric submersible pump having an internal passageway extending longitudinally through the electric submersible pump to receive a logging tool system therethrough, the electric submersible pump comprising a production fluid flow path separate from the internal passageway such that the internal passageway does not receive production fluid flow.

8. The system as recited in claim 7, wherein the electric submersible pumping system comprises a plurality of shaft sections, the internal passageway being located within the plurality of shaft sections.

9. The system as recited in claim 8, further comprising the logging tool system, wherein the logging tool system comprises a logging tool coupled to a wireline.

10. The system as recited in claim 8, further comprising the logging tool system, wherein the logging tool system comprises a logging tool coupled to a slick line.

11. The system as recited in claim 7, wherein the electric submersible pumping system comprises a submersible pump powered by a submersible motor, a motor protector, and a lower motor protector.

12. The system as recited in claim 9, further comprising a logging plug to seal the wireline cable to a head of the electric submersible pumping system.

13. The system as recited in claim 12, wherein the head comprises a latch mechanism to receive and hold the logging plug.

14. The system as recited in claim 9, wherein the logging tool system comprises a wireline guard to shield the wireline from the plurality of shaft sections.

15. A method, comprising:

moving a logging tool through a shaft of a motor protector of an electric submersible pumping system deployed in a wellbore; and performing a logging operation on a downhole side of the electric submersible pumping system while operating the electric submersible pumping system.

16. The method as recited in claim 15, wherein moving comprises moving the logging tool via a line routed within a longitudinal passageway through the shaft.

17. The method as recited in claim 16, further comprising withdrawing the logging tool from the shaft and blocking the longitudinal passageway.

18. The method as recited in claim 16, further comprising operating the electric submersible pumping system while the line moves within the longitudinal passageway.

* * * * *